US005719346A

United States Patent [19]

Yoshida et al.

[11] Patent Number: 5,719,346

[45] Date of Patent: Feb. 17, 1998

[54] HARMONY CHORUS APPARATUS GENERATING CHORUS SOUND DERIVED FROM VOCAL SOUND

[75] Inventors: Masao Yoshida; Yuichi Nagata; Kiyoto Kuroiwa; Satoshi Suzuki; Mikio Kitano, all of Hamamatsu, Japan

[73] Assignee: Yamaha Corporation, Hamamatsu, Japan

[21] Appl. No.: 597,437

[22] Filed: Jan. 31, 1996

[30] Foreign Application Priority Data

Feb. 2, 1995 [JP] Japan ..... 7-016181

[51] Int. Cl.[6] ..... G10H 1/36

[52] U.S. Cl. ..... 84/631; 84/634; 84/650; 434/307 A

[58] Field of Search ..... 84/633, 634, 650, 84/656, 666, 619, 657, 685, 631; 434/307 A

[56] References Cited

U.S. PATENT DOCUMENTS

| | | | |
|---|---|---|---|
| 5,194,682 | 3/1993 | Okamura et al. | 84/625 |
| 5,243,123 | 9/1993 | Chaya | 84/609 |
| 5,296,643 | 3/1994 | Kuo et al. . | |
| 5,428,708 | 6/1995 | Gibson et al. | 395/2.79 |
| 5,477,003 | 12/1995 | Muraki et al. | 84/610 |

FOREIGN PATENT DOCUMENTS

| | | |
|---|---|---|
| 501483 | 9/1992 | European Pat. Off. . |
| 509812 | 10/1992 | European Pat. Off. . |
| 62-89095 | 4/1987 | Japan . |
| 8805200 | 7/1988 | WIPO . |

*Primary Examiner*—William M. Shoop, Jr.
*Assistant Examiner*—Marlon T. Fletcher
*Attorney, Agent, or Firm*—Loeb & Loeb LLP

[57] ABSTRACT

A harmony chorus apparatus collects an original of a vocal sound performed after a main melody pattern of a song, and adds a chorus sound derived after a chorus melody pattern of the same song to the vocal sound. A memory stores a main melody data representative of the main melody pattern and a chorus melody data representative of the chorus melody pattern which is designed in harmony with the main melody pattern. A pitch difference calculator sequentially retrieves the main melody data and the chorus memory data from the memory in synchronization with progression of the song, and calculates a pitch difference between the main melody pattern and the chorus memory pattern according to the retrieved main melody data and chorus melody data. A chorus generator shifts a pitch of the collected vocal sound by the calculated pitch difference to generate the chorus sound in the form of a variation of the vocal sound. A mixing device mixes the generated variation of the vocal sound and the collected original of the vocal sound with each other to thereby create a harmony of the song.

29 Claims, 4 Drawing Sheets

HARMONY CHORUS APPARATUS GENERATING CHORUS SOUND DERIVED FROM VOCAL SOUND

BACKGROUND OF THE INVENTION

The present invention relates to a harmony chorus apparatus or a harmonizing effector which can be utilized suitably for a network karaoke system.

These days the karaoke system has become so popular, and users demand a wide variety of entry song titles available by the karaoke system. A so-called network karaoke system has been developed in which a song data is downloaded from a host computer having a data base of huge numbers of songs to retailers such as karaoke parlors through telecommunication.

In the prior art, there is known a karaoke system in which a harmony voice musically harmonious with a user's singing voice is automatically added to a vocal sound of the singing voice. Such a system generates a chorus sound having a fixed pitch, for example, shifted three degrees relative to the singing voice picked up by a microphone. Harmonization is effected by mixing the harmony voice with the original singing voice.

Generally, the pitch of a note harmonizing with another note varies depending on a key or scale of the song. The pitch of a harmony voice for a certain note in A minor is different from that in C major, for example. A suitable harmony pitch is different in one case than another. For instance, either of minor third or major third may be selected adequately to achieve favorable harmonization. Further, from a musical point of view, it is possible to shift the pitch of the harmony voice upper and lower relative to a main melody according to progression of a song in order to introduce variations into harmony structure of the song. Thus, a simple and uniform shift of the harmony voice from the original voice at a fixed pitch, which is done in the prior art, is not enough to obtain a comfortable harmony voice. Such a harmonizing effect may be monotonous.

SUMMARY OF THE INVENTION

The purpose of the present invention is to provide a harmonizing effector, which can add a harmony voice or a chorus sound having a pitch difference varying relative to the original voice in response to progression of the song, and which can achieve a harmonizing effect comfortable and rich in variety.

In order to achieve the object described above, according to the present invention, a harmony chorus apparatus collects an original of a vocal sound performed after a main melody pattern of a song, and adds a chorus sound derived after a chorus melody pattern of the same song to the vocal sound. The apparatus comprises a memory that stores a main melody data representative of the main melody pattern and a chorus melody data representative of the chorus melody pattern which is designed in harmony with the main melody pattern; a pitch difference calculator that sequentially retrieves the main melody data and the chorus memory data from the memory in synchronization with progression of the song and that calculates a pitch difference between the main melody pattern and the chorus memory pattern according to the retrieved main melody data and the chorus melody data; a chorus generator that shifts a pitch of the collected vocal sound by the calculated pitch difference to generate the chorus sound in the form of a variation of the vocal sound; and a mixing device that mixes the generated variation of the vocal sound and the collected original of the vocal sound with each other to thereby create a harmony of the song.

In a specific form, the harmony chorus further comprises a chorus tone controller that varies frequency characteristics of the generated chorus sound according to the calculated pitch difference to thereby improve a tone of the chorus sound.

In another specific form, the harmony chorus apparatus further comprises a chorus volume controller that regulates a volume of the generated chorus sound according to the calculated pitch difference so that the volume is made smaller as the pitch difference becomes greater.

According to the present invention, the memory stores the main melody data representing the main melody pattern of the song, as well as the chorus melody data representing the chorus melody pattern corresponding to the main melody pattern. The pitch difference calculator reads out the main melody data and the chorus melody data from the memory in synchronism with the progression of the song, and calculates the pitch difference between the main melody pattern and the chorus melody pattern based on both of the retrieved data. The chorus generator generates the chorus sound by shifting the pitch of the collected vocal sound in response to the calculated pitch difference. The mixing device reproduces the generated chorus sound together with the original vocal sound. Thus, the chorus sound having the pitch tracking the chorus melody pattern corresponding to the main melody pattern of the song is mixed to the vocal sound. Further, according to the present invention, the tone of the chorus sound to be added can be modified in response to the pitch difference between the vocal sound and the chorus sound. Still further, according to the present invention, the volume of the chorus sound can be controlled smaller as the pitch difference between the vocal sound and the chorus sound becomes greater.

DETAILED DESCRIPTION OF THE INVENTION

Figure 1:
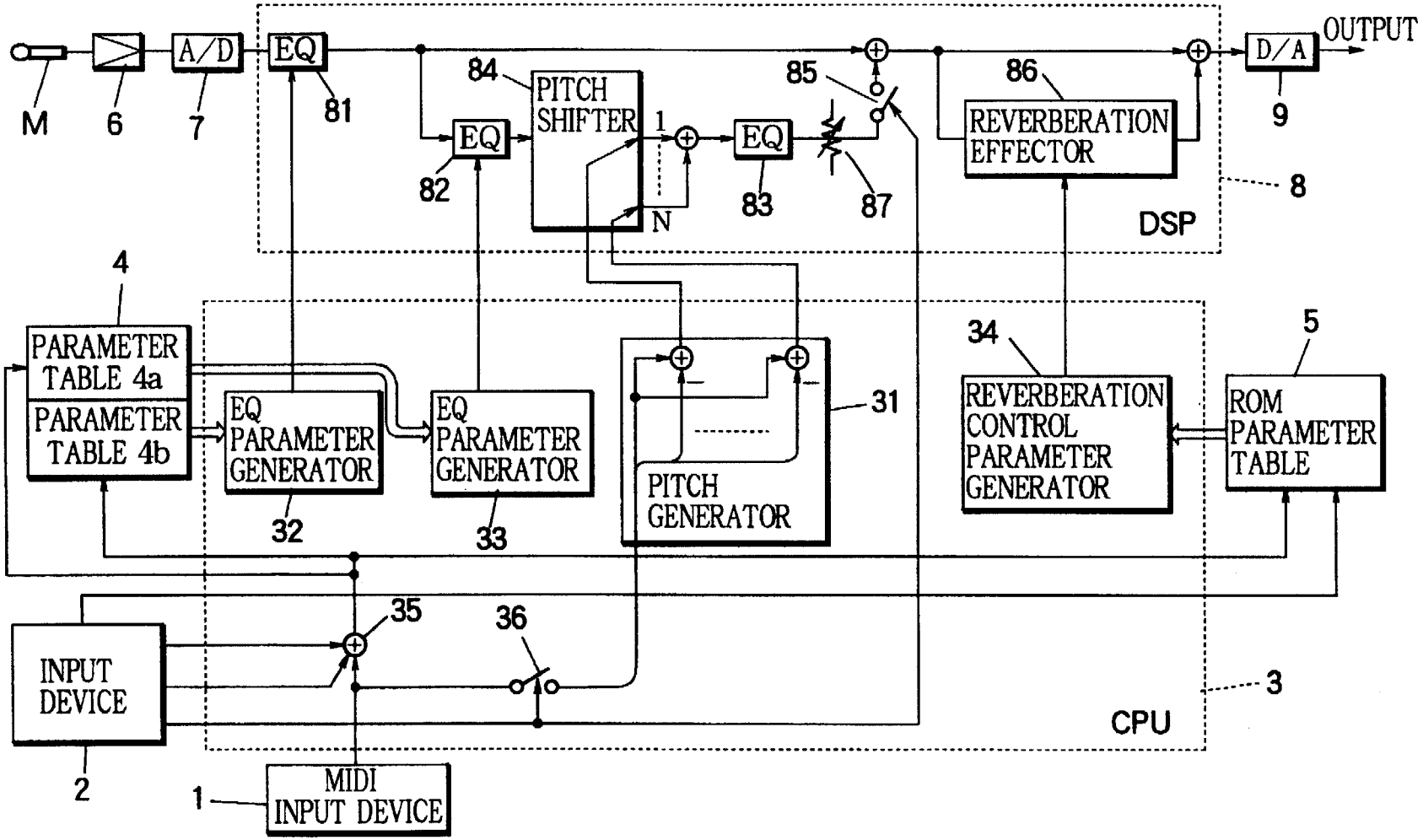
FIG. 1 is a schematic block diagram showing an arrangement of a harmonizing effector according to an embodiment of the present invention.

FIG. 1 shows a preferred embodiment of the chorus harmony apparatus or harmonizing effector according to the present invention. The apparatus may be employed in an online network karaoke system which receives song data in MIDI format from a host computer via communication network, which stores the song data in a hard disk or a CD-ROM, and which reproduces a requested song by reading out the stored song data.

In FIG. 1, the apparatus comprises a MIDI input device 1 to accept MIDI song data from external memory media (not shown) such as a hard disk, a manual input device 2 to interface with users, a CPU (Central Processing Unit) 3 to control each device and to compute control parameters, ROMs (Read Only Memory) 4 and 5 storing tables of control parameters, an amplifier 6 to amplify a vocal sound picked up by a microphone M, an A/D (Analog/Digital) converter 7 to convert an analog signal of the amplified vocal sound into a digital signal, a DSP (Digital Signal Processor) 8 to carry out a variety of signal processing for the digitally converted vocal signal, and a D/A (Digital/Analog) converter 9 to convert the processed digital signal into an analog signal and to feed it to an external sound system (not shown).

The external memory medium such as the hard disk stores the song data of each entry karaoke song, including a main melody data representative of a main melody pattern, an accompaniment data used to reproduce an accompanying instrumental sound, and a chorus melody data representative of a monophonic or polyphonic chorus pattern corresponding to the main melody pattern. The song data is transmitted from the host computer. Each song data further contains mode information such as a music genre data (e.g., pops, jazz, ballad etc.) of the song, and a select data effective to select either of a harmony mode accompanied with the chorus sound or a normal mode without the chorus sound. In the reproduction of the karaoke accompaniment, the accompaniment data is fed to a sound source (not shown) to reproduce the karaoke accompaniment. At the same time, the main melody data, the chorus melody data and the mode information are fed to the CPU 3, while being converted from MIDI domain to TTL domain.

The input device 2 is accommodated in the apparatus, or provided as a remote controller. The input device 2 accepts user's manual input commands, and outputs control information in response to the commands to the CPU 3. The user inputs various data including male/female discrimination, delay time/repeat gain of reverberation to be added to the vocal sound and so on, in addition to the mode information. The input device 2 is used to control parameters which should be adjusted according to preference of the user, tone or volume of the voice, performance of EQ (equalizer) and echo level (repeat gain) or delay time of an effector. These parameters are preset for individual users in a memory and are read out from the memory. The mode information can be inputted from either of the MIDI input device 1 or the manual input device 2 by selecting 'automatic input' or 'manual input' alternatively. Thus, if 'automatic input' is selected by the operation of the device 2, the mode information provided through the MIDI input device 1 is adopted. On the other hand, if 'manual input' is selected, the mode information provided through the manual input device 2 is adopted. The CPU 3 executes predetermined control programs to carry out prescribed functions as achieved by the following blocks 31 to 36. A pitch generator 31 calculates a pitch difference between the main melody pattern and the chorus melody pattern. The obtained value of the pitch shift (pitch difference) is inputted to the DSP S. An EQ (equalizer) parameter generator 32 sets filtering factors of an input equalizer 81 contained in the DSP 8 according to control parameters read out from a parameter table **4*b* of the ROM 4 in response to the mode information. Another EQ parameter generator 33 sets up filtering factors of a chorus input equalizer 82 contained in the DSP 8 according to control parameters which are read out from another parameter table 4*a* of the ROM 4 in response to attribute information. The EQ parameter generator 33 further sets up filtering factors of an output equalizer 83 and a volume of a chorus level controller 87. A reverberation control parameter generator 34 sets filtering factors of a reverberation effector 86 contained in the DSP 8 according to control parameters which are read out from a parameter table stored in the ROM 5 in response to the mode information and the input values of delay time and repeat gain. An automatic/manual selector 35 is actuated to take the mode information and attribute information from the manual input device 2 when 'manual input' is selected by the operation of the device 2. Then, the mode and attribute information is fed to the ROMs 4 and 5 to specify filter and reverberation parameter data in the tables of the ROMs 4 and 5. On the other hand, if 'automatic input' is selected, the automatic/manual selector 35 is switched to take the mode and attribute information from the MIDI input device 1. Then, the mode and attribute information is fed to the ROMs 4 and 5 to specify filter and reverberation parameter data in the parameter tables of the ROMs 4 and 5. A mode selector 36 is turned on if the harmony mode is selected by the operation of the input device 2. Consequently, the main melody data and the chorus melody data are distributed from the MIDI input device 1 to the pitch generator 31. On the other hand, if the normal mode is selected, the mode selector 36 is turned off. Consequently, the data is not supplied to the pitch generator 31**.

As described above, the parameter tables **4*a* and 4*b* are allocated in the ROM 4, and the tables store the control parameters to be set in the input equalizer 81 and the chorus input equalizer 82 of the DSP 8. According to the attribute information such as male/female identification and personal preference, the parameter table 4*a* specifies filtering factors to be set in the equalizer 82 such as filter cutoff frequencies, frequencies dominating equalizer characteristics, gain, and Q value. The table 4*a* is also accessed to specify the chorus output level of the chorus level controller 87. The other parameter table 4*b* is accessed in similar manner to specify control factors to be set in the input equalizer 81 according to the mode information such as a reproduction mode, the genre of the song and so on. The ROM 5 stores the parameter table used to set control factors in the reverberation effector 86 accommodated in the DSP 8. The parameter table stores control parameters such as echo level, delay time, repeat gain etc., which are used to set the reverberation effector 86** according to the mode information described above.

The DSP 8 is comprised of the input equalizer 81, the chorus input equalizer 82, the chorus output equalizer 83, a pitch shifter 84, the chorus level controller 87, a mode selector switch 85, and the reverberation effector 86. The input equalizer 81 is comprised of a quadratic HPF (High Pass Filter), a linear LPF (Low Pass Filter), and three-staged equalizer units connected in series. The cutoff frequencies of the HPF and LPF and the filter factors of each equalizing unit (frequencies, gain, and Q) are set up by the EQ parameter generator 32 as described above. The chorus input equalizer 82 is comprised of a serial connection of a quadratic LSF (Low Shelving Filter), a quadratic HSF (High Shelving Filter), and a single equalizer unit. The cutoff frequencies of the LSF and HSF and the filter factors of the equalizing unit (frequencies, gain, and Q) are established by the EQ parameter generator 33 as described above. The pitch shifter 84 shifts the pitch of the output of the equalizer 82 according to the pitch difference between the main melody and the chorus melody, calculated by the pitch generator 31. For the pitch shifter 84, it is possible to employ a conventional arrangement disclosed in JP-A-62-89095, for example. In this arrangement, a target frequency after the pitch shift is registered correspondingly to the pitch shift value for each note. In this embodiment, the conventional arrangement should be modified to a multiple input/output configuration in order to deal with multiple chorus melodies 1 to N in parallel manner. The chorus output equalizer 83 eliminates unnecessary frequency components such as a noise yielded by the pitch shift of the pitch shifter 84 in the chorus sound. The chorus level controller 87 adjusts the chorus sound level or volume when mixed to the singer's vocal sound. The mode selector switch 85 turns on and off by interlocking with the mode selector 36 of the CPU 3. The switch turns on in case that the reproduction of the sound is placed in the harmony mode, and turns off in the normal mode.

Figure 2:
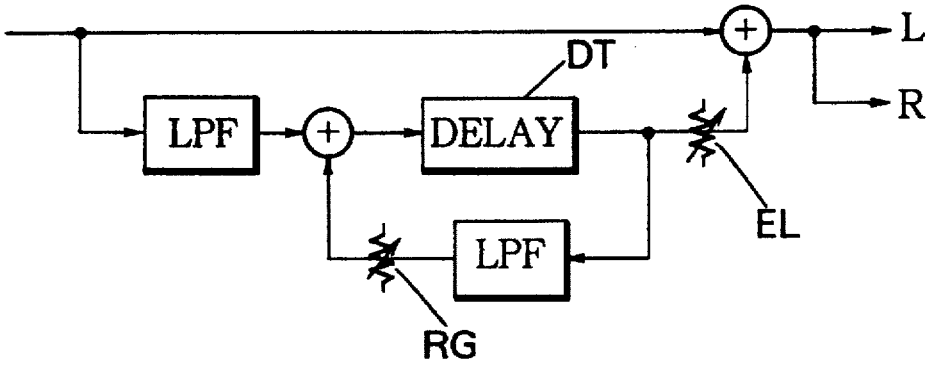
FIG. 2 is a schematic block diagram showing a structure of a reverberation effector provided in the embodiment of the present invention.

The reverberation effector 86 imparts various effects such as 'reverb', 'echo' and so on to the audio signal produced by mixing the chorus sound signal and the vocal sound signal. The reverberation effector 86 can adopt one of the structures shown in FIGS. 2 to 6. In the embodiment of FIG. 2, an input audio signal is divided out and fed to a LPF and is delayed by a delay circuit. Then, the filtered and delayed signals are added together and are concurrently fed back to the input of the delay circuit and then added with the original signal in order to obtain a desired echo effect. In this embodiment, the echo level (EL in FIG. 2), the repeat gain (RG in FIG. 2), and the delay time (DT in FIG. 2) are controlled according to the mode information.

Figure 3:
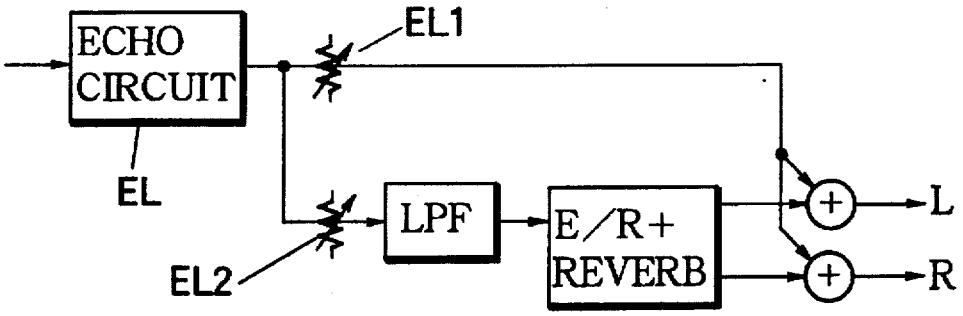
FIG. 3 is a schematic block diagram showing a different structure of the reverberation effector in the embodiment of the present invention.

In FIG. 3, a reverb circuit is connected in series to the echo circuit of FIG. 2 in order to obtain echo and reverb effect for the input audio signal. In addition to the echo level (EL in FIG. 3) in the echo circuit, the echo levels EL1 and EL2 can be adjusted to control the whole effect in this embodiment.

Figure 4:
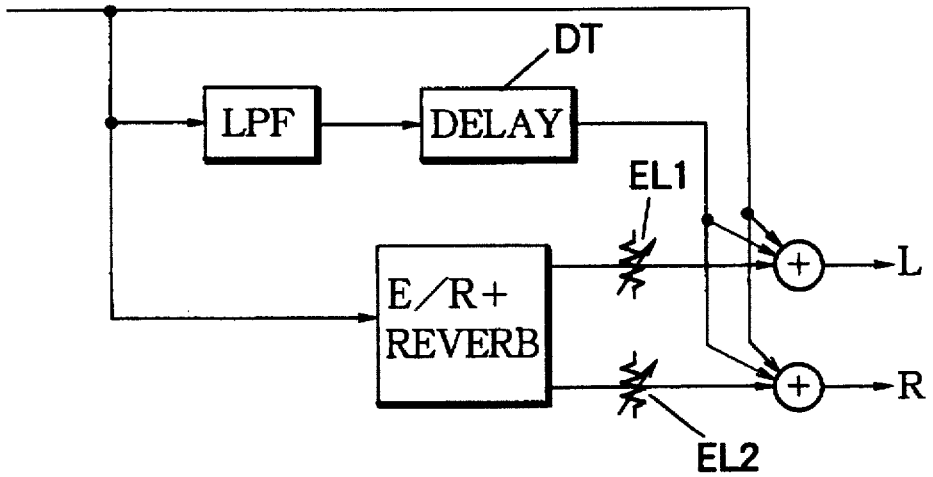
FIG. 4 is a schematic block diagram showing another different structure of the reverberation effector in the embodiment of the present invention.

In the embodiment of FIG. 4, both of delay and reverb effects are added to the input audio signal in parallel. In FIG. 4, the delay time (DT in FIG. 4), the echo levels (EL1 and EL2 in FIG. 4) for the left and right channels L and R can be adjusted.

Figure 5:
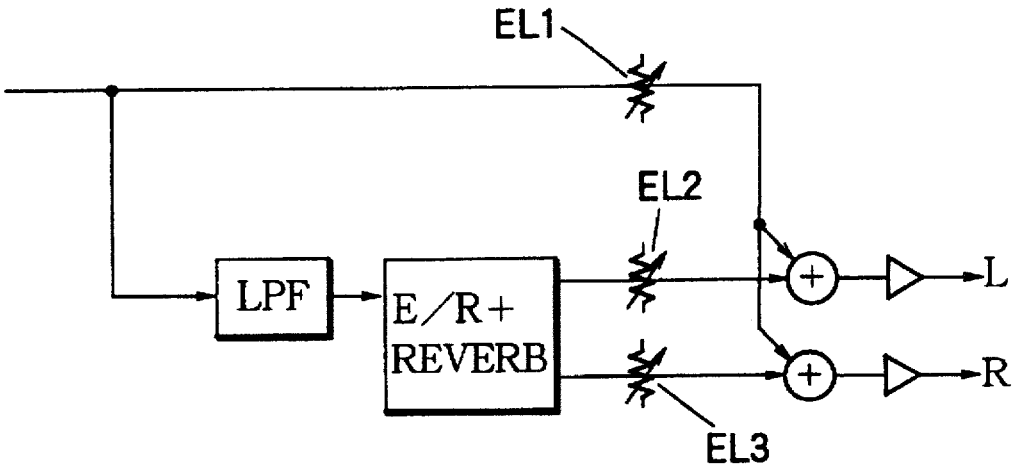
FIG. 5 is a schematic block diagram showing a further different structure of the reverberation effector in the embodiment of the present invention.

In FIG. 5, only a reverb effect is added to the input audio signal. In this embodiment, the echo levels are adjusted for the input signal and for the reverb output signals of the left and right channels (EL1 to EL3 in FIG. 5).

Figure 6:
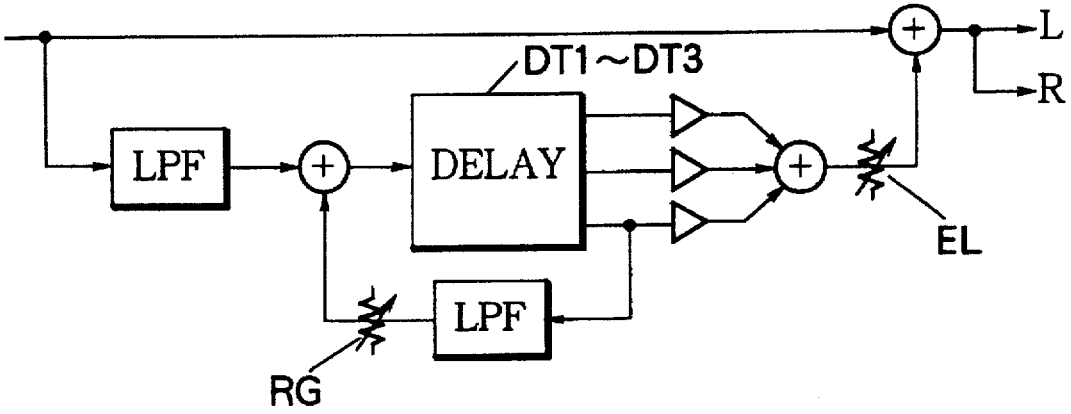
FIG. 6 is a schematic block diagram showing a still further different structure of the reverberation effector in the embodiment of the present invention.

In FIG. 6, by adding a delay effect with different delay times to the input audio signal, a portion of the delay output is fed back to the input end to obtain the echo effect. In this embodiment, the repeat gain (RG in FIG. 6), each delay time (DT1 to DT3 in FIG. 6), and the echo level (EL in FIG. 6) can be controlled.

The operation of the harmonizing effector according to the present invention will now be described hereunder. The description is given separately for two cases of the manual input mode in which the mode information is supplied through the input device 2, and the automatic input mode in which the mode information is entered together with the MIDI song data from the MIDI input device.

(1) Manual Input Mode

When the user selects the manual input mode by the operation of the input device 2 after power is on the apparatus is switched to the manual input mode. In the manual input mode, the user is required to select either of the harmony mode or the normal mode, and to input the music genre of the song to be performed. The user inputs the attribute information such as male/female identification, personal preference, and reverb control data such as delay time, repeat gain etc. After commanding the performance through by the input device 2, the song data to be reproduced is read from the external memory medium and is received through the MIDI input device 1. The accompaniment data included in the song data is distributed to an accompaniment sound source (not shown), while the main melody data, the monophonic or polyphonic chorus melody data and the mode information are distributed to the CPU 3.

The CPU 3 can accept the mode information from both of the manual input device 2 and the MIDI input device 1. However, in this manual input mode, the mode information distributed from the manual input device 2 is selected by the automatic/manual selector 35, so that the control parameters are read out from the ROMs 4 and 5 according to the manually inputted mode information. The control parameters corresponding to the attribute information are also read out from the ROM 4, and the control parameters corresponding to the delay time and the repeat gain are read out from the ROM 5.

Now, the operations in the harmony mode and the normal mode, which are selected by the input device 2, are separately explained hereunder.

On selecting the harmony mode by the operation of the input device 2, the mode selector 36 is turned on, and the main melody data and the chorus melody data are supplied to the pitch generator 31. The pitch generator 31 calculates the value of the pitch difference between the main melody data and the chorus melody data, and distributes the value to the pitch shifter 84 in the DSP 8. Parameters corresponding to the harmony mode and the genre of the song are set up in the input equalizer 81, while parameters corresponding to the attribute information are set up in the chorus input equalizer 82. For the reverberation effector 86, parameters containing a delay time, a repeat gain, and an echo level are selected correspondingly to the harmony mode and the genre of the song. Further, parameters corresponding to the input delay time, repeat gain, and echo level are set up by reading them from the ROM 5. The voice signal of the original vocal sound created by the user is picked up through the microphone M, converted into a digital signal through the amplifier 6 and A/D converter 7, and fed to the DSP 8. In the DSP 8, the frequency characteristic of the voice is altered to create a tone suitable for the harmony mode and for the genre of the song by means of the input equalizer 81. The voice signal is divided into a direct vocal sound channel and a chorus sound channel. The chorus input equalizer 82 adjusts the tone of the voice signal divided into the chorus sound channel suitably according to the attribute information such as male/female identification and personal preference to performance of the karaoke song.

Then, the pitch of the output of the equalizer 82 is shifted according to the pitch difference between the main and chorus melody patterns by the pitch shifter 84, so that the chorus sound harmonizing with the vocal sound is produced. The multiple of the chorus sounds are mixed with each other, and are fed to the chorus output equalizer 83 to eliminate unnecessary frequency components such as noise. In this harmony mode, the mode selector switch 85 is turned on, so that the chorus sound signals are added to the original voice signal of the direct sound channel.

The reverberation effector 86 provides the mixture of the vocal sound signal and the chorus sound signal with the reverberation effect. In this harmony mode, the echo level is suppressed to avoid excessive reverberation because the chorus sound is already mixed to the vocal sound. Thus, the DSP 8 produces the final sound signal added with the chorus sound and the light reverberation. The signal is fed to the D/A converter 9 to convert the digital signal into an analog signal. Then, the analog signal is sent to the external sound system to be reproduced along with the karaoke accompaniment sound through a loudspeaker.

On the other hand, if the normal mode is selected by the input device 2, both of the mode selector 36 and the mode selector switch 85 are turned off. Thus, the chorus sound generation is stopped, so that the vocal signal collected by the microphone M is fed to the input equalizer 81 to adjust the tone suitable for the song genre, and is then added with the effect such as reverb and echo by the reverberation effector 86. The final signal is outputted to the external sound system to be reproduced without any chorus sounds. In this normal mode, a louder echo level and a longer delay time are selected for the operation of the reverberation effector 86, because no chorus sound is mixed to the vocal sound.

Now, the operation in the automatic input mode is described below.

If the automatic input mode is selected by the operation of the input device 2, the apparatus is switched to this mode. In the automatic input mode, mode information distributed from the MIDI input device 1 is selected by the automatic/manual selector 35. The parameters corresponding to the mode information are read out from the ROMs 4 and 5. In this mode, user's mode information inputted from the input device 2 is ignored. However, the user's input of attribute information such as male/female, delay time, repeat gain and else are accepted via the input device 2. Yet, it is possible to configure the apparatus to accept the mode information input through the manual input device 2 with a priority over the automatic information input only during the song performance. The operation in the automatic input mode is the same as in the abovedescribed manual input mode, except that the filter parameters for the equalizers 81 to 83 are set up according to the mode information inputted through the MIDI input device 1.

In the embodiment described above, the pitch of the vocal sound is shifted according to the monophonic or polyphonic chorus melody pattern arranged in conformity with the main melody pattern of the song to generate the chorus sound after the chorus melody pattern. Consequently, the monophonic or polyphonic line of the chorus melody can be added according to the mood and the progression of the song. The tone of the voice can be controlled according to the attribute information such as male/female difference and personal preference. Further, the suppression of the reverberation effects in the harmony mode enables to prevent excessive reverberation from being added to the vocal sound.

The present invention is not limited within the extent of the embodiment explained above, and can be modified as described below.

Figure 7:
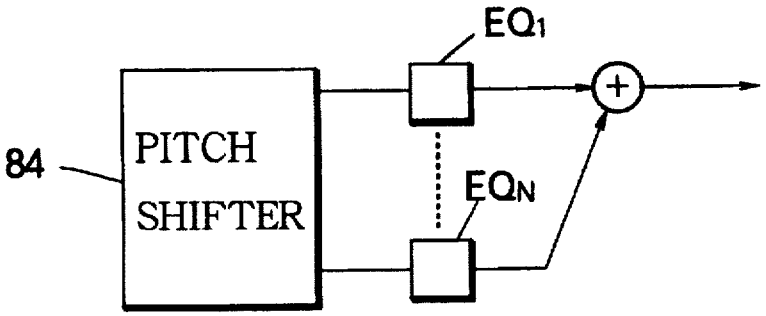
FIG. 7 is a schematic block diagram showing a variation of the embodiment in which equalizers are provided in association with respective chorus melody outputs of a pitch shifter.

(1) As shown in FIG. 7, it is possible to provide equalizers $EQ_1$ to $EQ_N$ for each chorus sound output of the pitch shifter 84 in order to variably control the frequency characteristics according to the pitch shift amount of each chorus sound signal. In this arrangement, the output of the pitch generator 33 can be utilized as a control parameter corresponding to the pitch shift amount. Thus, the tone of each chorus line can be adjusted suitably for the pitch difference between the original vocal sound and the derived chorus sound. The comfortable harmonizing sound can be obtained.

Figure 8:
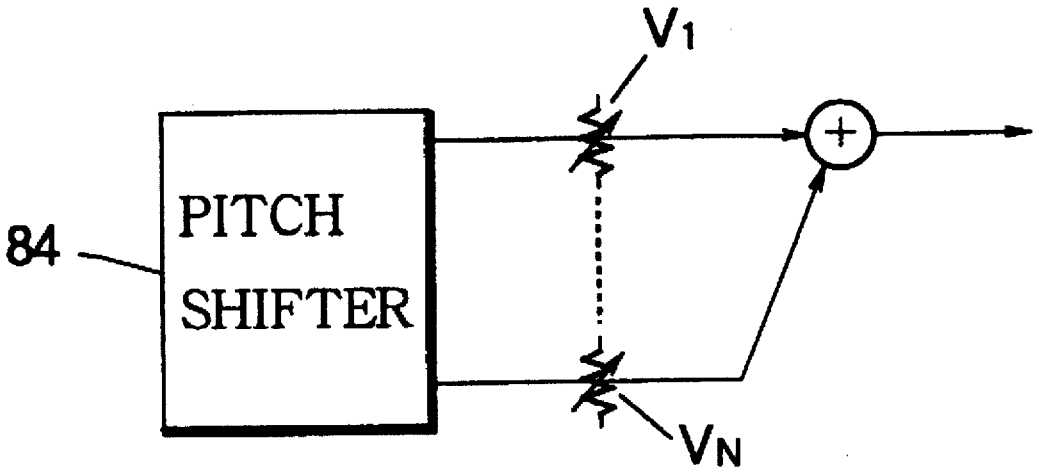
FIG. 8 is a schematic block diagram showing another variation of the embodiment in which attenuators are provided in association with respective chorus melody outputs of the pitch shifter.

(2) As shown in FIG. 8, it is possible to provide attenuators $V_1$ to $V_N$ for each chorus sound output of the pitch shifter 84 in order to control or regulate the volume dependently on the pitch shift amount of each chorus sound signal. Also in this arrangement, the output of the pitch generator 33 can be utilized as a control parameter representative of the pitch shift amount. In this arrangement, the greater the pitch difference between the main melody and the chorus melody, the smaller the volume of the harmonizing chorus sound, in order to prevent the chorus sound having a great pitch difference from emerging out too much. The arrangements shown in FIGS. 7 and 8 can be combined with each other.

(3) It is possible to configure the apparatus to return to the normal mode at the end of every song performance. MIDI song data contains control codes signifying top and end of a song. The end of the song can be detected by the code. In this arrangement, users do not have to specify the reproduction mode for each song performance, so that operation can be simplified in case that the harmony mode is not so frequently selected. If desired, other mode settings relating to music genre, for instance, can be automatically controlled in a similar manner.

(4) If a chorus part is already included in the original karaoke song, the reproduction of the chorus part included in the song data can be turned on and off in association with the harmony or normal mode switching. Thus, overlapping of the separate chorus part and the chorus sound generated by the harmonizing effector of the embodiment can be avoided.

(5) The input equalizer 81 is controlled according to the mode information relating to the modes of the reproduction, music genre etc., while the chorus level controller 87 is controlled in response to the attribute information relating sex of the singer, personal deviations and so on in the disclosed embodiment. However, any of the equalizers or level controllers can be controlled according to the mode and attribute information in different manner.

(6) Further, the embodiment described above is assumed to be employed in the network karaoke system. However, the present invention can be applied to any types of the karaoke system. Further, the harmonizing chorus sound may be generated not only for the vocal sound signal picked up by the microphone, but also for a musical sound signal reproduced from a recording medium in synchronism with the song progression.

The present invention includes specific forms described below.

(1) The inventive harmony chorus apparatus includes an input device that inputs attribute information to characterize performance of the song, and a controller such as an equalizer and an attenuator that operates according to the inputted attribute information to modify a tone of either of the vocal sound and the chorus sound and to regulate a volume of the chorus sound. In this form of the invention, the tone of the vocal or chorus sound, and the chorus output level can be adjusted in reproduction of the song according to the attribute information relating to the music genre, sex of the singer, personal deviation etc. Thus, it is possible to obtain variety of chorus effects suitable for properties such as the music genre, sex of the singer, personal preference etc.

(2) The inventive harmony chorus apparatus includes an effector that imparts an effect including reverberation to the collected vocal sound, a selector that selects either of a harmony mode in which the chorus sound is mixed to the vocal sound and a normal mode in which no chorus sound is mixed to the vocal sound, and a suppressing device that operates when the harmony mode is selected for suppressing the effect which would disturb the created harmony of the song. In this form of the invention, the volume or delay time of the reverberation added to the vocal sound can be suppressed in the harmony mode as compared to the normal mode. Thus, it is possible, in the harmony mode, to avoid excessive reverberation. The comfortable harmonizing sound can be derived.

(3) The inventive harmony chorus apparatus includes a selector that selects either of a harmony mode in which the chorus sound is mixed to the vocal sound and a normal mode in which no chorus sound is mixed to the vocal sound, a detector that detects an end of performance of each song, and a switching device that operates when the end of the performance is detected under the harmony mode for commanding the selector to switch from the harmony mode to the normal mode to thereby restore the normal mode for performance of a next song. In this form of the invention, it is possible to switch the harmony mode to the normal mode automatically at the end of a song played in the harmony mode. Thus, the harmony mode can be automatically switched to the normal mode at the end of the song played in the harmony mode, so that burden on the mode switching operation can be reduced.

(4) The inventive harmony chorus apparatus includes a selector that selects either of a harmony mode in which the chorus sound is mixed to the vocal sound and a normal mode in which no chorus sound is mixed to the vocal sound, and a switching device that operates when the song is performed with a chorus part independently from the vocal sound for commanding the selector to switch to the normal mode, and that operates when the song is performed without a chorus part for commanding the selector to switch to the harmony mode. In this form of the invention, it is possible to switch the reproduction mode automatically so that if the song data contains any chorus part, the vocal sound is reproduced without the chorus sound generation. If the song data contains no chorus part, the vocal sound is added with the chorus sound in the harmony mode. Thus, overlapping of the original chorus part contained in the song data and the chorus sound generated by the apparatus can be avoided.

As described above, the present invention makes it possible to add the chorus melody harmonizing with the main melody of a song so that users can enjoy harmony that is comfortable and rich in variety. Further, it is possible to add the chorus voice having a tone adjusted for the pitch difference between the vocal sound and chorus sound, so that the harmony can be enriched. Further, the greater the pitch difference between the vocal sound and the chorus sound, the smaller the volume of the chorus sound, so that it is possible to prevent the chorus sound from standing out too much, thereby enriching the harmony.

What is claimed is:

1. A harmony chorus apparatus for collecting an original vocal sound performed by an user of the apparatus following a main melody pattern of a song, and for adding a chorus sound derived following a chorus melody pattern of the same song to the vocal sound, the apparatus comprising:

a memory for storing main melody data representative of the main melody pattern and chorus melody data representative of the chorus melody pattern which is in harmony with the main melody pattern;

a pitch difference calculator for sequentially retrieving the main melody data and the chorus melody data from the memory in synchronization with a progression of the song, and for calculating a pitch difference between the main melody pattern and the chorus melody pattern according to the retrieved main melody data and the chorus melody data;

a chorus generator for shifting a pitch of the collected vocal sound by the calculated pitch difference to generate the chorus sound in the form of a variation of the vocal sound; and a mixing device for mixing the generated variation of the vocal sound and the collected original vocal sound to create a harmony of the song.

2. A harmony chorus apparatus according to claim 1, further comprising a chorus tone controller for varying frequency characteristics of the generated chorus sound according to the calculated pitch difference to improve a tone of the chorus sound.

3. A harmony chorus apparatus according to claim 1, further comprising a chorus volume controller that regulates a volume of the generated chorus sound according to the calculated pitch difference so that the volume is made smaller as the pitch difference becomes greater.

4. A harmony chorus apparatus according to claim 1, further comprising an input device for inputting attribute information to characterize a performance of the song, and a controller responsive to the inputted attribute information for modifying a tone of either the vocal sound or the chorus sound and for regulating a volume of the chorus sound.

5. A harmony chorus apparatus according to claim 1, further comprising a selector for selecting either a harmony mode in which the chorus sound is mixed to the vocal sound or a normal mode in which no chorus sound is mixed to the vocal sound.

6. A harmony chorus apparatus according to claim 5, further comprising an input equalizer for altering a frequency characteristic of the vocal sound to create a tone suitable for the harmony mode.

7. A harmony chorus apparatus according to claim 1, further comprising a chorus input equalizer for adjusting a tone of the vocal sound according to attribute information.

8. A harmony chorus apparatus according to claim 6, further comprising a first parameter table for storing control parameters to be set in the input equalizer.

9. A harmony chorus apparatus according to claim 7, further comprising a pitch shifter for shifting a pitch of an output of the chorus input equalizer according to the pitch difference between the main melody pattern and the chorus melody pattern to harmonize the chorus sound and the vocal sound.

10. A harmony chorus apparatus according to claim 1, further comprising a chorus output equalizer for eliminating unnecessary frequency components from the chorus sound.

11. A harmony chorus apparatus according to claim 9, further comprising an attenuator for controlling a volume of a chorus sound output of the pitch shifter based on a pitch shift amount of the chorus sound output.

12. A harmony chorus apparatus according to claim 4, wherein the attribute information includes a gender of a singer, a personal deviation, and a music genre.

13. A harmony chorus apparatus according to claim 1, further comprising an effector for imparting an effect including reverberation to the collected vocal sound.

14. A harmony chorus apparatus according to claim 5, further comprising a suppressing device for suppressing an effect which would disturb the created harmony of the song when the harmony mode is selected.

15. A harmony chorus apparatus according to claim 5, further comprising a detector for detecting an end of performance of each song.

16. A harmony chorus apparatus according to claim 15, further comprising a first switching device for commanding the selector to switch from the harmony mode to the normal mode to restore the normal mode for performance of a next song in response to a detection of the end of a performance.

17. A harmony chorus apparatus for collecting an original vocal sound performed by an user of the apparatus following a main melody pattern of a song, and for adding a chorus sound derived following a chorus melody pattern of the same song to the vocal sound, the apparatus comprising:

a memory for storing main melody data representative of the main melody pattern and chorus melody data representative of the chorus melody pattern which is in harmony with the main melody pattern;

a pitch difference calculator for sequentially retrieving the main melody data and the chorus melody data from the memory in synchronization with progression of the song, and for calculating a pitch difference between the main melody pattern and the chorus melody pattern according to the retrieved main melody data and the chorus melody data;

a chorus generator for shifting a pitch of the collected vocal sound by the calculated pitch difference to generate the chorus sound in the form of a variation of the vocal sound;

a mixing device for mixing the generated variation of the vocal sound and the collected original vocal sound to create a harmony of the song;

an effector for imparting an effect including reverberation to the collected vocal sound;

a selector for selecting either a harmony mode in which the chorus sound is mixed to the vocal sound or a normal mode in which no chorus sound is mixed to the vocal sound; and a suppressing device for suppressing the effect which would disturb the created harmony of the song in response to a selection of the harmony mode.

18. A harmony chorus apparatus according to claim 17, further comprising a second parameter table for storing control parameters to be set in the effector.

19. A harmony chorus apparatus for collecting an original vocal sound performed by an user of the apparatus following a main melody pattern of a song, and for adding a chorus sound derived following a chorus melody pattern of the same song to the vocal sound, the apparatus comprising:

a memory for storing main melody data representative of the main melody pattern and chorus melody data representative of the chorus melody pattern which is in harmony with the main melody pattern;

a pitch difference calculator for sequentially retrieving the main melody data and the chorus melody data from the memory in synchronization with a progression of the song, and for calculating a pitch difference between the main melody pattern and the chorus melody pattern according to the retrieved main melody data and the chorus melody data;

a chorus generator for shifting a pitch of the collected vocal sound by the calculated pitch difference to generate the chorus sound in the form of a variation of the vocal sound;

a mixing device for mixing the generated variation of the vocal sound and the collected original vocal sound to create a harmony of the song;

a selector for selecting either a harmony mode in which the chorus sound is mixed to the vocal sound or a normal mode in which no chorus sound is mixed to the vocal sound;

a detector for detecting an end of performance of each song; and a first switching device for commanding the selector to switch from the harmony mode to the normal mode to restore the normal mode for performance of a next song in response to a detection of the end of a performance under the harmony mode.

20. A harmony chorus apparatus for collecting an original vocal sound performed by an user of the apparatus following a main melody pattern of a song, and for adding a chorus sound derived following a chorus melody pattern of the same song to the vocal sound, the apparatus comprising:

a memory for storing main melody data representative of the main melody pattern and chorus melody data representative of the chorus melody pattern which is in harmony with the main melody pattern;

a pitch difference calculator for sequentially retrieving the main melody data and the chorus melody data from the memory in synchronization with a progression of the song, and for calculating a pitch difference between the main melody pattern and the chorus melody pattern according to the retrieved main melody data and the chorus melody data;

a chorus generator for shifting a pitch of the collected vocal sound by the calculated pitch difference to generate the chorus sound in the form of a variation of the vocal sound;

a mixing device for mixing the generated variation of the vocal sound and the collected original vocal sound to create a harmony of the song;

a selector for selecting either a harmony mode in which the chorus sound is mixed to the vocal sound or a normal mode in which no chorus sound is mixed to the vocal sound; and a second switching device for commanding the selector switch to switch to the normal mode if the song has a chorus part, and for commanding the selector switch to switch to the harmony mode if the song does not have the chorus part so that an overlap of the chorus part in the song with the generated variation of the vocal sound can be avoided.

21. A method of collecting an original vocal sound performed by an user of the apparatus following a main melody pattern of a song and adding a chorus sound derived following a chorus melody pattern of the same song to the vocal sound, the method comprising the steps of:

selecting an input mode;

storing main melody data representative of the main melody pattern and chorus melody data representative of the chorus melody pattern which is in harmony with the main melody pattern in a memory;

retrieving the main melody data and the chorus melody data from the memory in synchronization with progression of the song;

calculating a pitch difference between the main melody pattern and the chorus melody pattern according to the retrieved main melody data and the chorus melody data;

shifting a pitch of the collected vocal sound by the calculated pitch difference to generate the chorus sound in the form of a variation of the vocal sound; and mixing the generated variation of the vocal sound and the collected original vocal sound with each other to create a harmony of the song.

22. A method according to claim 21, further comprising the step of varying frequency characteristics of the generated chorus sound according to the calculated pitch difference to enrich the tone of the chorus sound.

23. A method according to claim 21, further comprising the step of regulating a volume of the generated chorus sound according to the calculated pitch difference so that the volume is made smaller as the pitch difference becomes greater.

24. A method according to claim 21, further comprising the steps of retrieving attribute information to characterize performance of the song and reading control parameters corresponding to the attribute information.

25. A method according to claim 24, further comprising the step modifying a tone of either the vocal sound or the chorus sound and regulating a volume of the chorus sound according to the attribute information.

26. A method according to claim 21, further comprising the step of imparting an effect including reverberation to the collected vocal sound.

27. A method according to claim 21, further comprising the step of selecting either a harmony mode in which the chorus sound is mixed to the vocal sound or a normal mode in which no chorus sound is mixed to the vocal sound.

28. A method according to claim 21, further comprising the step of detecting an end of performance of each song.

29. A method according to claim 27, further comprising the step of switching from the harmony mode to the normal mode to restore the normal mode for performance of a next song when the end of the performance is detected under the harmony mode.

* * * * *